US006267326B1

(12) United States Patent
Smith et al.

(10) Patent No.: US 6,267,326 B1
(45) Date of Patent: Jul. 31, 2001

(54) UNIVERSAL DRIVER CIRCUIT FOR ACTUATING BOTH VALVES AND ORDNANCES

(75) Inventors: Gregory H. Smith, Placentia; Roland D. Clark, Whittier, both of CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/370,545

(22) Filed: Aug. 9, 1999

(51) Int. Cl.[7] ..... F41G 7/00; F42B 15/01

(52) U.S. Cl. ..... 244/3.22; 244/3.15; 244/3.21; 701/3

(58) Field of Search ..... 244/3.1, 3.15, 244/3.16–3.29, 3.3; 701/100, 3, 99, 120, 121–123; 89/6, 6.5, 1.11, 1.1

(56) References Cited

U.S. PATENT DOCUMENTS 3,568,954 * 3/1971 McCorkle, Jr. ..... 244/3.2
3,708,139 1/1973 Wheeler .
3,908,933 9/1975 Goss et al. .
3,926,390 * 12/1975 Teuber et al. ..... 244/3.22
4,618,931 * 10/1986 Miller et al. ..... 701/100
4,624,424 11/1986 Pinson .
5,102,065 4/1992 Couderc et al. .
5,310,143 5/1994 Yocum et al. .
5,696,347 12/1997 Sebeny, Jr. et al. .
5,742,609 4/1998 Kondrak et al. .
5,811,788 9/1998 Wicke .

* cited by examiner

*Primary Examiner*—Bernarr E. Gregory
(74) *Attorney, Agent, or Firm*—Alston & Bird LLP

(57) ABSTRACT

A universal driver circuit is provided for actuating both valves and ordnances, such as the valves and ordnances carried by a missile or other unmanned air vehicle. The universal driver circuit includes at least one valve driver circuit for controllably opening and closing a valve and at least one ordnance driver circuit for controllably activating an ordnance. In addition, the universal driver circuit includes a controller capable of independently directing each valve driver circuit and each ordnance driver circuit to open the valve and to activate the ordnance, respectively.

19 Claims, 6 Drawing Sheets

UNIVERSAL DRIVER CIRCUIT FOR ACTUATING BOTH VALVES AND ORDNANCES

FIELD OF THE INVENTION

The present invention relates generally to control circuitry for an unmanned air vehicle, such as a missile, and, more particularly, to control circuitry for actuating valves and ordnances.

BACKGROUND OF THE INVENTION

In order to control the flight and other operational characteristics of an unmanned air vehicle, such as a missile, a conventional missile includes a significant amount of control electronics. Among other things, the control electronics control the flight of the missile by selectively activating the valves that propel and direct the missile toward its target. In this regard, the control electronics control valves which are designed to obtain fuel from the combustion chambers. In addition, the control electronics direct the operation of a number of sensors and other instruments which aid in the guidance of the missile as well as the operation of communications equipment. Additionally, the control electronics typically activates the batteries associated with the on-board electrical equipment, such as sensors, instruments, communications equipment and the like, in order to activate the on-board electrical equipment. Likewise, the control electronics typically squib the pressure tanks in order to build pressure in the fuel tank and the oxidizer tank.

Conventionally, the control circuitry of missiles or other unmanned air vehicles includes separate driver circuits, each of which typically includes a separate controller, for providing control signals to respective electrical subsystems. For example, separate driver circuits are generally associated with each valve in order to control the associated thrust. In this regard, a valve driver circuit would typically provide signals to the solenoid of the respective valve that cause the valve to open or close. In instances in which the valve is open, a mixture of a fuel with an oxidizer is typically provided from the combustion chamber which causes the missile to be propelled in a desired direction. Alternatively, in instances in which the valve is closed, fuel is no longer provided from the combustion chamber and no further propulsion is provided. Since more current is generally required in order to initially open a valve as opposed to maintaining a valve in an open position, the control electronics associated with the valve of each engine preferably initially provides a pull-in current in order to open the valve and then subsequently provides a hold current, which is significantly less than the pull-in current, in order to maintain the valve in the open position.

In addition to the separate driver circuits that are typically required for the solonoid of each valve, separate driver circuits are typically required for actuating each ordnance or squib carried by the missile. In this regard, ordnances or squibs are typically associated with batteries carried by the missile such that the actuation of an ordnance activates the respective battery which, in turn, provide power to an associated electrical subsystem, such as a sensor, an instrument, communications equipment or the like. In addition, ordnances or squibs can be disposed between the pressure tanks and the fuel tank and the oxidizer tank in order to cause the fuel and oxidizer tanks to be pressurized upon actuating of the ordnances.

As will be apparent, unmanned air vehicles, such as missiles, typically have stringent restrictions on the maximum permissible weight that can be carried without hampering its performance. Likewise, unmanned air vehicles have only a limited volume to house its various components as well as the fuel required for propulsion.

However, since separate driver circuits are typically provided for each valve and each ordnance, the control electronics of a conventional unmanned air vehicle are unfortunately relatively heavy and occupy a significant amount of space. In order to reduce the weight of the control electronics and to reduce the space consumed by the control electronics, a multi-channel driver circuit has been developed for controlling a plurality of valves. In this regard, the multi-channel driver circuit includes a plurality of valve drivers associated with respective valves and operating under control of a common controller, such as a programmable logic device. As such, the multi-channel driver circuit can individually actuate each valve, in order to open the valve and provide fuel to the respective engine. In particular, each valve driver can provide a pull-in current for a predetermined pull-in time in order to initially open the valve and can then provide a reduced level of current, namely, a hold current, for the remainder of the period during which the valve is held in an open position. Depending on the application, the pull-in current, the hold current, and the respective times for providing the pull-in current and the hold current can be individually set for each valve.

While the multi-channel driver circuit for controlling a plurality of valves does assist in reducing the weight of the control electronics and correspondingly reducing the space consumed by the control electronics, separate driver circuits are still required for controllably actuating the plurality of ordnances since ordnances have different current requirements for actuation than the valves. In this regard, ordnances typically require a pulse of relatively high current, such as 4 amps minimum, while a valve typically requires the application of a pull-in current that is significantly lower than the pulse of current provided to an ordnance, such as 1.8 amps in most cases, followed by the provision of an even lower hold current, such as 0.8 amps, for the remainder of the time that the valve is open. As such, a need still exists to reduce the weight of the control electronics onboard a missile or other unmanned air vehicle and to reduce the space consumed by the control electronics onboard a missile or other unmanned air vehicle.

SUMMARY OF THE INVENTION

A universal driver circuit is therefore provided for actuating both valves and ordnances, such as the valves and ordnances carried by a missile or other unmanned air vehicle. By employing a common driver circuit for both the valves and ordnances, the weight of the control electronics and the space consumed by the control electronics onboard the missile or other unmanned air vehicle is reduced relative to conventional control circuitry that requires either a separate driver circuit for each valve and ordnance or that has a multi-channel driver circuit for the valves, but still requires a separate driver circuit for each ordnance. Since the universal driver circuit must actuate both valves and ordnances, the universal driver circuit includes separate valve driver circuits and ordnance driver circuits for selectively actuating the valves and ordnances, respectively. In order to conserve weight, power and space, the valve driver circuits and the ordnance driver circuits preferably utilize at least some common components, such as a common controller, and are preferably mounted upon the same circuit board.

The apparatus of the present invention that actuates both valves and ordnances therefore includes at least one valve driver circuit for controllably opening and closing a valve and at least one ordnance driver circuit for controllably activating an ordnance. In addition, the apparatus includes a controller capable of independently directing each valve driver circuit and each ordnance driver circuit to open the valve and to activate the ordnance, respectively. As such, the operations of each valve driver circuit and each ordnance driver circuit are typically directed by the same controller, thereby reducing the number of components, lowering the weight, reducing the volume requirement, and saving on power in comparison to conventional control circuitry.

Each ordnance driver circuit preferably includes a power switch for controllably providing current, such as a relatively large pulse of current, to the ordnance to activate the ordnance. In order to protect the ordnance by limiting the current that can be provided to the ordnance, each ordnance driver circuit can also include a resistive element disposed in series with the ordnance. In addition, each ordnance driver circuit can include a control switch disposed between the controller and the power switch for providing control signals of the appropriate voltage level to the power switch such that the proper current can be provided to the ordnance in order to activate the ordnance. As such, the controller can direct the control switch to appropriately configure the power switch to provide a first predetermined current to the ordnance in order to activate the ordnance. Typically, the ordnance driver circuit provides a relatively large pulse of current, such as 4 to 8 amps, to the ordnance in order to activate the ordnance.

Each valve driver circuit also preferably includes a power switch for controllably providing current to the valve in order to open the valve. In addition, each valve driver circuit preferably includes a comparator for comparing a measure of the current provided to the valve by the power switch to a predetermined value. In response to the comparison of a measure of the current provided to the valve to a predetermined value, the controller can modify the current provided to the valve in order to maintain the current at or near a predetermined current level. In one advantageous embodiment, the controller is capable of directing the power switch of each valve driver circuit to initially provide a predetermined pull-in current to the valve in order to open the valve and to subsequently provide a predetermined hold current to the valve in order to maintain the valve in an open position. In this embodiment, the comparator therefore initially compares a measure of the current provided to the valve to a first predetermined value corresponding to the predetermined pull-in current and subsequently compares a measure of the current provided to the valve to a second predetermined value corresponding to the predetermined hold current, such that the controller can maintain the current at or near the desired current levels at different stages in opening the valve. While the pull-in current is greater than the hold current, both the pull-in current and the hold current are generally significantly less than the pulse of current required to actuate the ordnances.

The universal driver circuit for controllably actuating both valves and ordnances therefore assists in the reduction in weight and the reduction in space required by the control electronics of a missile or other unmanned air vehicle. In this regard, the universal driver circuit weighs less and occupies a smaller space than conventional control electronics since the entire multi-channel universal driver circuit is typically mounted upon a common circuit board and certain components, such as the controller, function to control each of the valve driver circuits and the ordnance driver circuits in order to decrease the number of components required by the control electronics. As such, the missile or other unmanned air vehicle can either be lighter than conventional designs or other components can be carried by the missile or other unmanned air vehicle without increasing the overall weight in comparison to a missile or other unmanned air vehicle having conventional control electronics with separate valve driver circuits and separate ordnance driver circuits for each valve and ordnance, respectively.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
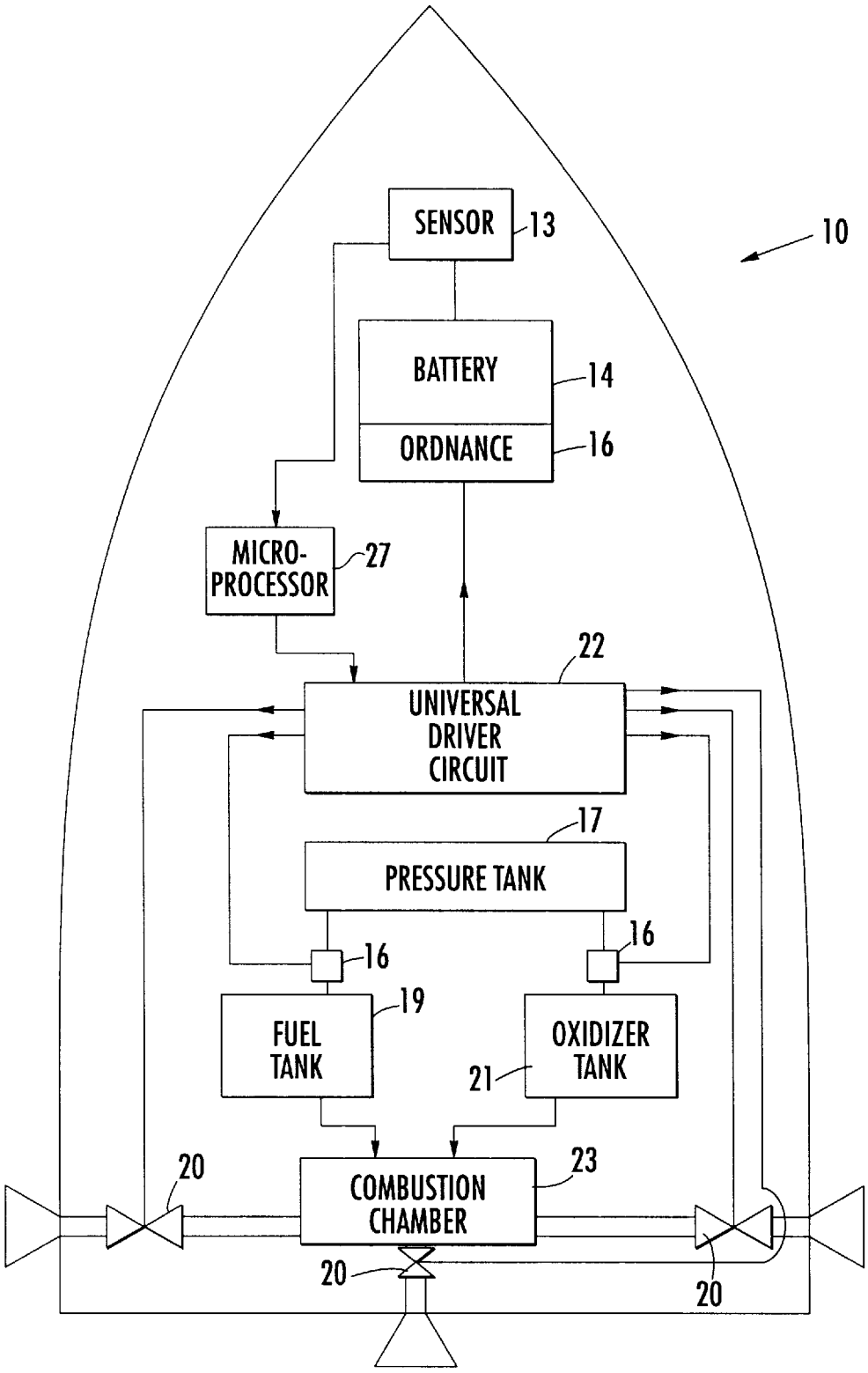
FIG. 1 is a schematic view of an unmanned air vehicle, such as a missile, according to one embodiment of the present invention having a plurality of ordnances and a plurality of valves controlled by a common universal driver circuit.

Referring now to FIG. 1, an unmanned air vehicle 10, such as a missile, is depicted according to one embodiment of the present invention. In addition to the vehicle body 12, the unmanned air vehicle includes a variety of electrical subsystems, such as sensors 13, instruments, communications equipment and the like. The unmanned air vehicle also includes batteries 14 associated with respective ones of the electrical subsystems for providing power to the respective electrical subsystems. In order to controllably activate the batteries so as to supply power to the respective electrical subsystems, the unmanned air vehicle also includes at least one ordnance or squib 16 (hereinafter referred to as an "ordnance") and, more typically, a plurality of ordnances disposed within the vehicle body. While the unmanned air vehicle can include a variety of ordnances, one common ordnance is a squib or electro-explosive device (EED). In this instance, each ordnance would typically be associated with a respective battery such that actuation of the ordnance activates the respective battery. Once activated, the battery begins providing power to the electrical subsystems connected to the battery. As such, by controllably actuating the ordnances and, in turn, controllably activating the batteries associated with the ordnances, the electrical subsystems powered by the respective batteries can be selectively activated during various stages of the flight as defined by a predetermined flight plan or as dictated by actual flight conditions. Ordnances can also be associated with pressurized tank(s) 17 as schematically depicted as valves in FIG. 1. Once actuated, the ordnances permit the pressurized tank to increase the pressure within the fuel and oxidizer tanks 19, 21 in order to force fuel and oxidizer into the combustion chamber 23 as shown in FIG. 1.

The unmanned air vehicle 10 can also include at least one valve 20 and, more typically, a plurality of valves for propelling the unmanned air vehicle. For example, a missile generally includes a plurality of valves for controllably delivering thrust at different locations relative to the centerline of the missile and, in some instances, at different angles relative to the centerline defined by the vehicle body. By controllably activating the valves, the unmanned air vehicle is therefore not only propelled, but is also controllably steered along a desired flight path.

The unmanned air vehicle 10 also generally includes a combustion chamber 23 associated with the fuel and oxidizer tanks 19, 21 for supplying fuel to the valves 20. As such, the thrust is generally deactivated in instances in which the valve is closed and fuel is not provided to the valve. Conversely, the thrust is generally activated in instances in which the valve is open and fuel is provided from the combustion chamber. Since the valves of most missiles permit a combination of two liquid chemicals, namely, a fuel and an oxidizer, to bum, the opening of the valve generally permits the two types of liquid chemicals to thrust the missile in the desired direction.

According to the present invention, the unmanned air vehicle 10 also includes an apparatus, typically referred to as a universal driver circuit 22, for controllably actuating both the valves 20 and ordnances 16 carried by the unmanned air vehicle. Since the universal driver circuit controls both valves and ordnances, the universal driver circuit includes at least one valve driver circuit 24 associated with the valve for a respective engine 18. As explained hereinbelow, the valve driver circuit serves to control the opening and closing of the respective valve by controllably actuating the solenoid associated with the valve. In addition, the universal driver circuit includes at least one ordnance driver circuit 26, associated with a respective ordnance, for controllably activating the ordnance. The universal driver circuit also includes a controller 28 for independently directing both the valve driver circuit and the ordnance driver circuit to open a valve and activate the ordnance, respectively. By including a common driver circuit for controllably actuating both the valves and the ordnances of an unmanned air vehicle, the weight of the control electronics and the space required by the control electronics of the present invention is reduced relative to conventional control electronics that require separate driver circuitry for each valve and each ordnance.

Figure 2:
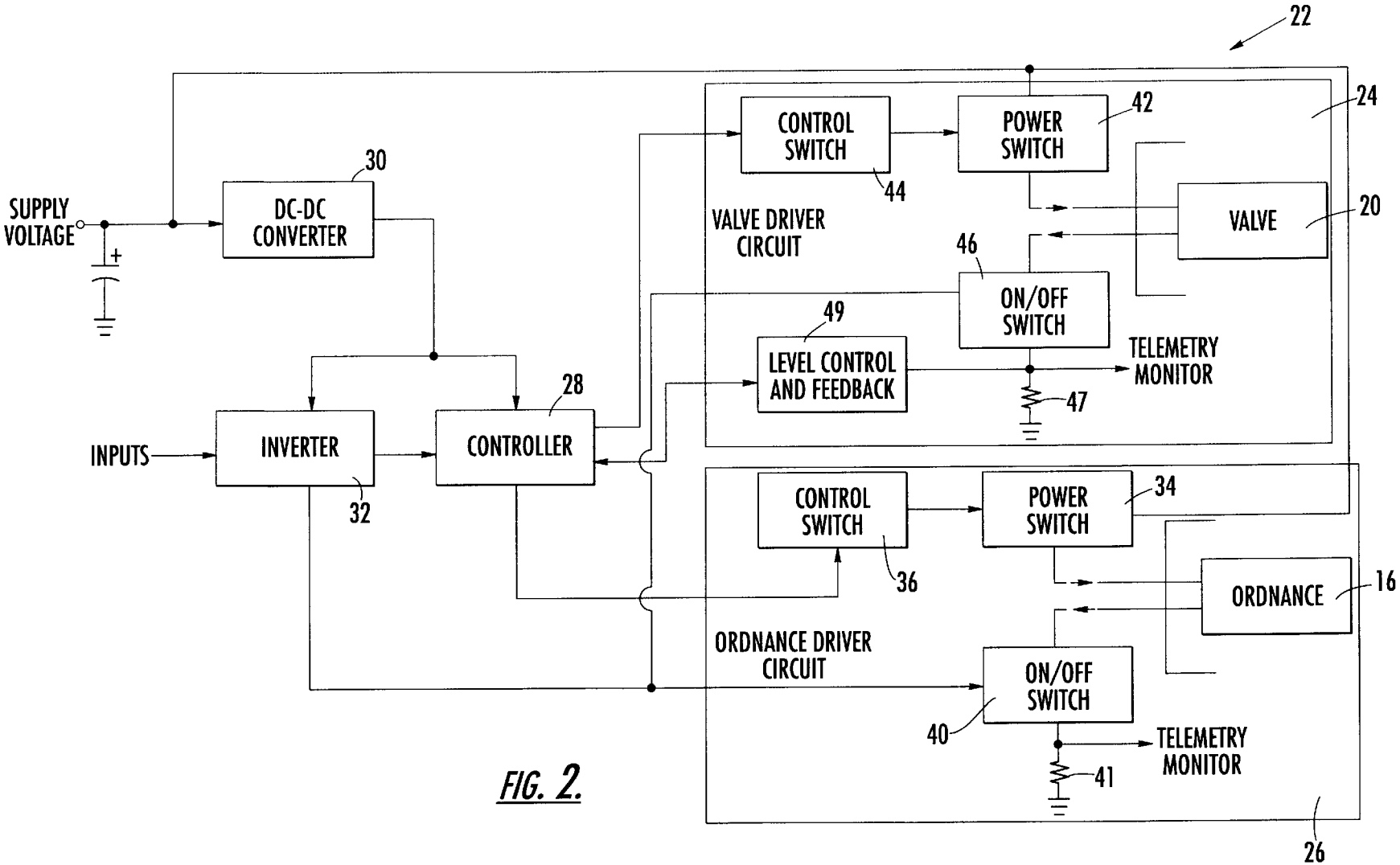
FIG. 2 is a block diagram of an apparatus for actuating both valves and ordnances according to one advantageous embodiment of the present invention.

Referring now to FIG. 2, a block diagram of a universal driver circuit 22 according to one advantageous embodiment of the present invention is depicted. As shown, the common controller 28 for the valve driver circuit 24 and the ordnance driver circuit 26 can be a multi-channel programmable logic device with one channel assigned to each of the valve driver circuits or the ordnance driver circuits. However, the controller need not be a programmable logic device, but can be a microprocessor or other type of controller without departing from the spirit and scope of the present invention. As shown, the controller receives both power and external inputs. With respect to powering the programmable logic device, the universal driver circuit is generally provided with a relatively large supply voltage, such as between about 24 VDC and 35 VDC. Since a controller, such as programmable logic device, requires a much lower input voltage, such as 5 VDC, the universal driver circuit typically includes a DC/DC converter 30, such as a step down flyback converter, to convert the relatively high input voltage to a lower voltage, such as 5 VDC.

In addition to power, the controller 28, such as the multi-channel programmable logic device, receives a plurality of external inputs for defining the desired state of the valves and ordnances. Typically, the multi-channel programmable logic device is designed to receive one input for each channel that defines the state of the valve or ordnance associated with the respective channel. Although the programmable logic device can be designed to receive a variety of inputs, the inputs are generally binary coded inputs having a low state, such as 0 volts, indicating that the respective valve or ordnance should not be actuated and a high state, such as 5 volts, indicating that the respective valve or ordnance should be actuated. While the inputs can be provided in a variety of manners, the inputs are typically provided by means of an optocoupler, a line driver or the like. For example, in the embodiment of FIG. 1, a microprocessor 27 provides the inputs which may be produced in response to information provided by a sensor 13. In addition, while the controller, such as the multi-channel programmable logic device, can be designed to receive input signals of any polarity, the universal driver circuit 22 can include an inverter 32, upstream of the controller, if the input signals are of the opposite polarity than those that the controller is designed to receive such that the controller will be able to properly process the input signals. In this instance, the inverter is also preferably powered by the DC/DC converter as shown in FIG. 2.

In addition to the controller 28, the universal driver circuit 22 includes at least one valve driver circuit 24 and at least one ordnance driver circuit 26. Each valve driver circuit and each ordnance driver circuit of a universal driver circuit is responsive to the controller 28 and, more typically, are connected to a respective channel of the multi-channel programmable logic device. As such, the controller can independently direct the valve driver circuits and the ordnance driver circuits to open respective ones of the valves 20 and to activate respective ones of the ordnances 16, respectively. While the universal driver circuit can include equal numbers of valve driver circuits and ordnance driver circuits, the universal driver circuit can include different numbers of valve driver circuits, such as five valve driver circuits and seven ordnance driver circuits in one exemplary embodiment.

Since the same controller 28 actuates both valves 20 and ordnances 16, the universal driver circuit 22 of the present invention generally has a reduced part count and consumes less power relative to conventional control electronics for unmanned air vehicles 10 which have a separate driver circuit for each valve and each ordnance. In addition, the controller and each of the valve driver circuits 24 and ordnance driver circuits 26 that are controlled by the controller can be mounted upon the same circuit board. As such, the universal driver circuit of the present invention preferably weighs less and consumes less space than conventional control electronics that require a separate driver circuit for each valve and ordnance. By way of example, the universal driver circuit of one embodiment that includes a 12-channel programmable logic device weighs approximately 90 grams and fills a volume of 3.65"×1.8"×0.27".

Figure 3:
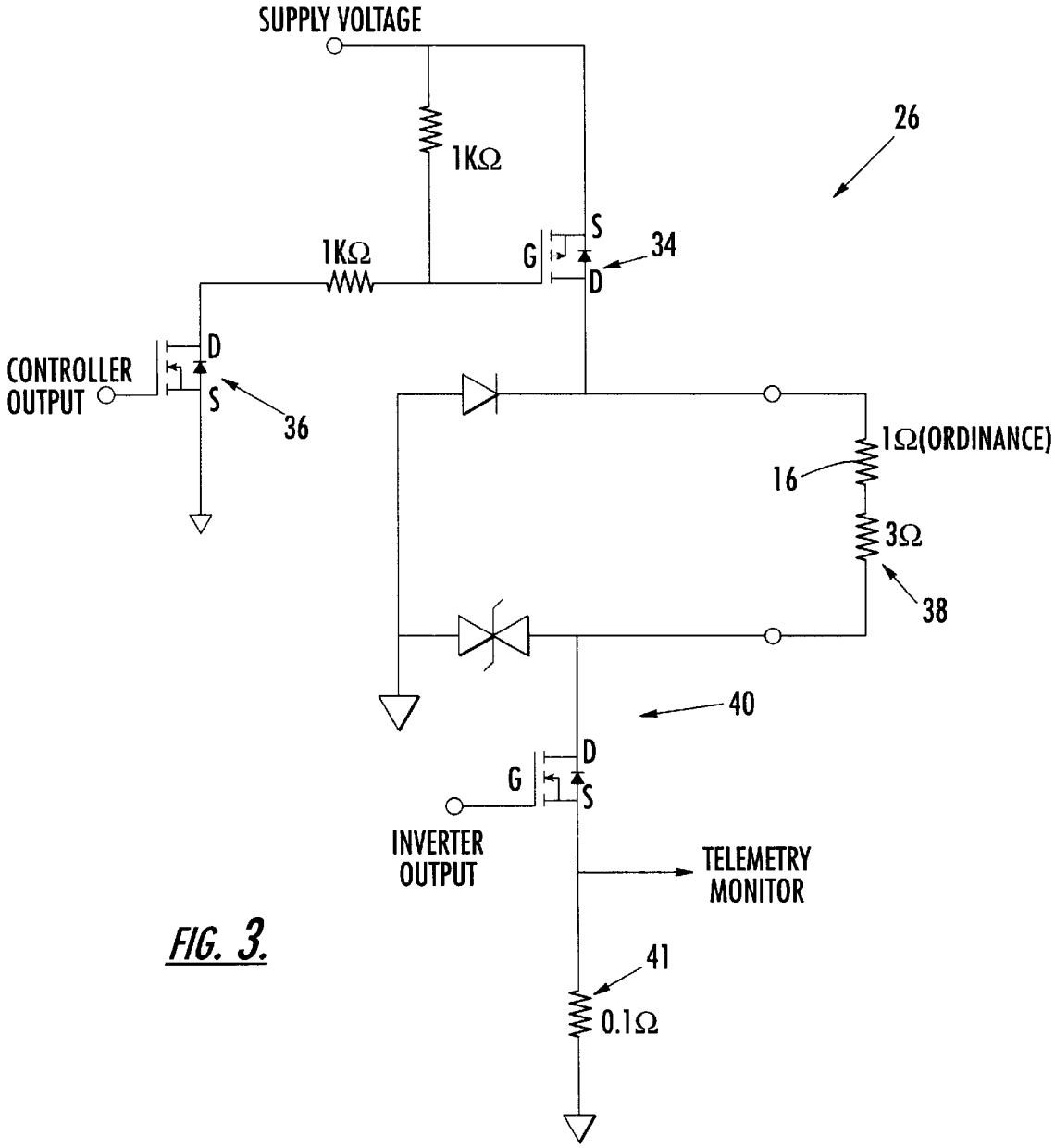
FIG. 3 is a circuit diagram of an ordnance driver circuit of the universal driver circuit of one advantageous embodiment of the present invention.

As shown in FIG. 2, each ordnance driver circuit 26 includes a power switch 34 for controllably providing current to the ordnance 16. In this regard, the power switch is typically a p-channel MOSFET that connects the ordnance to the supply voltage, typically between about 24 VDC and 35 VDC, in instances in which the power switch is closed, and isolates the ordnance from the supply voltage in instances in which the power switch is open. See, for example, FIG. 3 which depicts the circuit diagram of the ordnance driver circuit. While components of a particular size are depicted in FIG. 3, the components can change somewhat without departing from the spirit and scope of the invention since the circuit diagram is provided for means of an illustration.

As shown in FIG. 2, the power switch 34 of the ordnance driver circuit 26 is controllably opened and closed by the controller 28. Since the power switch is typically embodied by a p-channel MOSFET that requires much higher voltages for switching on and off than a controller, such as a programmable logic device, typically provides, the ordnance driver circuit can also include a control switch 36. As shown in the circuit diagram of the ordnance driver circuit, the control switch is preferably an n-channel MOSFET. The control switch is preferably connected between the controller and the power switch such that the control signals provided by the controller cause the control switch to appropriately bias the power switch in order to cause the power switch to controllably close and open, thereby connecting and disconnecting the ordnance to the supply voltage, respectively. In one embodiment in which the control switch is an n-channel MOSFET and the power switch is a p-channel MOSFET, the drain of the control switch can be connected to the gate of the power switch. A high output from the controller, such as a 5 V signal, will apply approximately half of the supply voltage to the gate of the power switch so as to close the power switch and provide current to the ordnance 16. Conversely, a low output from the controller, such as the a 0 V signal, will apply the supply voltage to the gate of the power switch so as to open the power switch and halt current flow to the ordnance.

Figure 4:
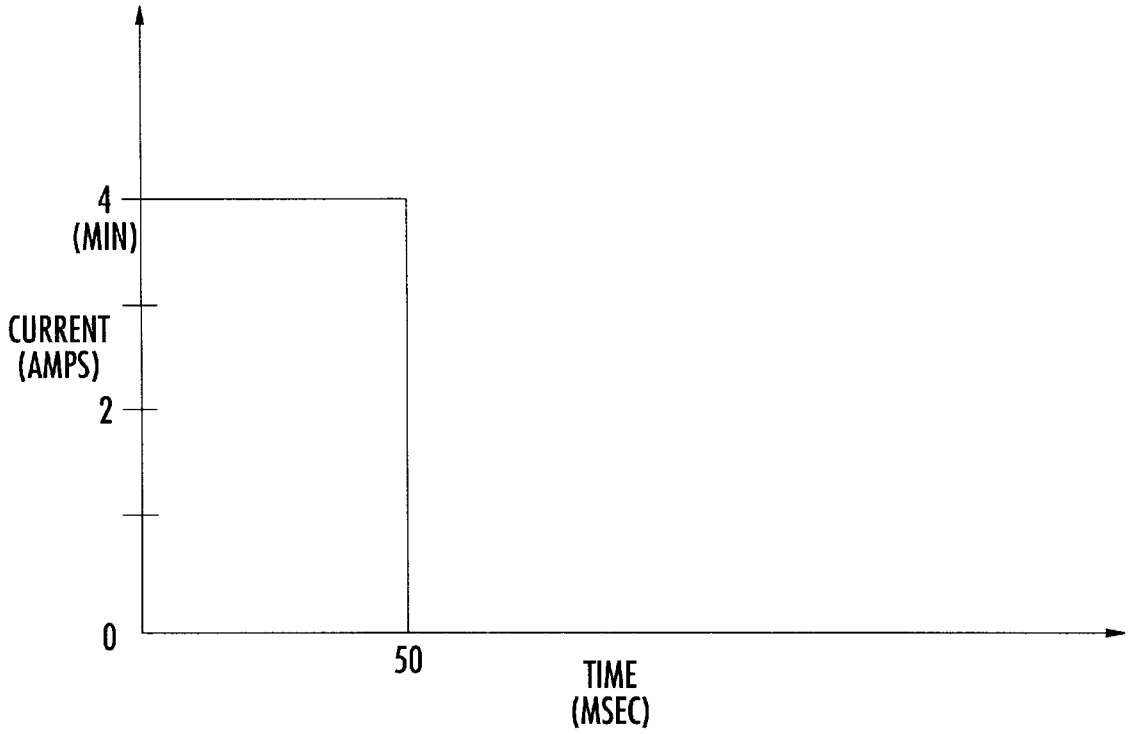
FIG. 4 is a graph of the current provided to an ordnance in order to actuate the ordnance.

Typically, an ordnance 10 is activated by applying a pulse of relatively high current, such as 4 amps minimum, to an ordnance for a limited period of time, such as 50 milliseconds, and thereafter removing the current. See, FIG. 4 which illustrates the pulse of current typically provided to actuate an ordnance.

The timing and duration of the pulse current provided to the ordnance 16 can be controlled by the controller 28, but is typically provided by the duration of the input pulse. In this regard, the controller generally provides the signal to initiate a pulse to the control switch 36 of the ordnance driver circuit 26 in response to an input that indicates that the ordnance be actuated. As described above, the control switch then causes the power switch 34 to close so as to provide current to the ordnance. Following actuation, the controller generally waits for the input signal to change states, such as by going from a high signal to a low signal, and then provides a signal to the control switch indicating that the ordnance should be deactivated by disconnecting the ordnance from the supply voltage. Generally, the controller will only allow the control switch to remain closed for some predetermined maximum time, such as 50 milliseconds, prior to causing the switch to open, irrespective of the input signal. The controller can therefore include an internal timer for measuring the predetermined period of time. In addition, the magnitude of the current provided to the ordnance 16 is dictated by the magnitude of the supply voltage and the resistance of the power switch 34, the ordnance and any other resistive elements in the current path. In this regard, most conventional ordnances can be modeled as a resistive element, as shown in FIG. 3. For example, a squib ordnance can be modeled as a 1 ohm resistor. Since a relatively large supply voltage is typically utilized, such as between about 24 VDC and 35 VDC, the ordnance driver circuit 26 also generally includes a resistive element 38, such as a resistor, disposed in series with the ordnance to limit the current provided to the ordnance. In this regard, the resistive element of approximately 3 ohms can be disposed in series with the ordnance in order to limit the current to between about 4 amps and 8 amps for a supply voltage of between 24 VDC and 35 VDC.

The ordnance driver circuit 26 can also include an on/off switch 40, such as another n-channel MOSFET, connected via a relatively small resistor 41, such as a 0.1 ohm resistor, to ground and connected in parallel to a voltage suppressor. The on/off switch is controlled by the input signals and, as more particularly shown by FIG. 2, by the output of the inverter 32 and is generally closed while the ordnance 16 is actuated so as to permit current to flow on through. However, the n-channel MOSFET of the on/off switch can quickly open in response to the input signal to halt current flow through the ordnance, thereby quickly deactivating or turning off the ordnance. As indicated in FIGS. 2 and 3, the signal appearing between the on/off switch and the relatively small resistor, such as the 0.1 ohm resistor, can be monitored in order to track the current flowing through the ordnance. This in-flight telemetry data can then be analyzed during flight or the data can be stored for subsequent analysis, if so desired.

Figure 5:
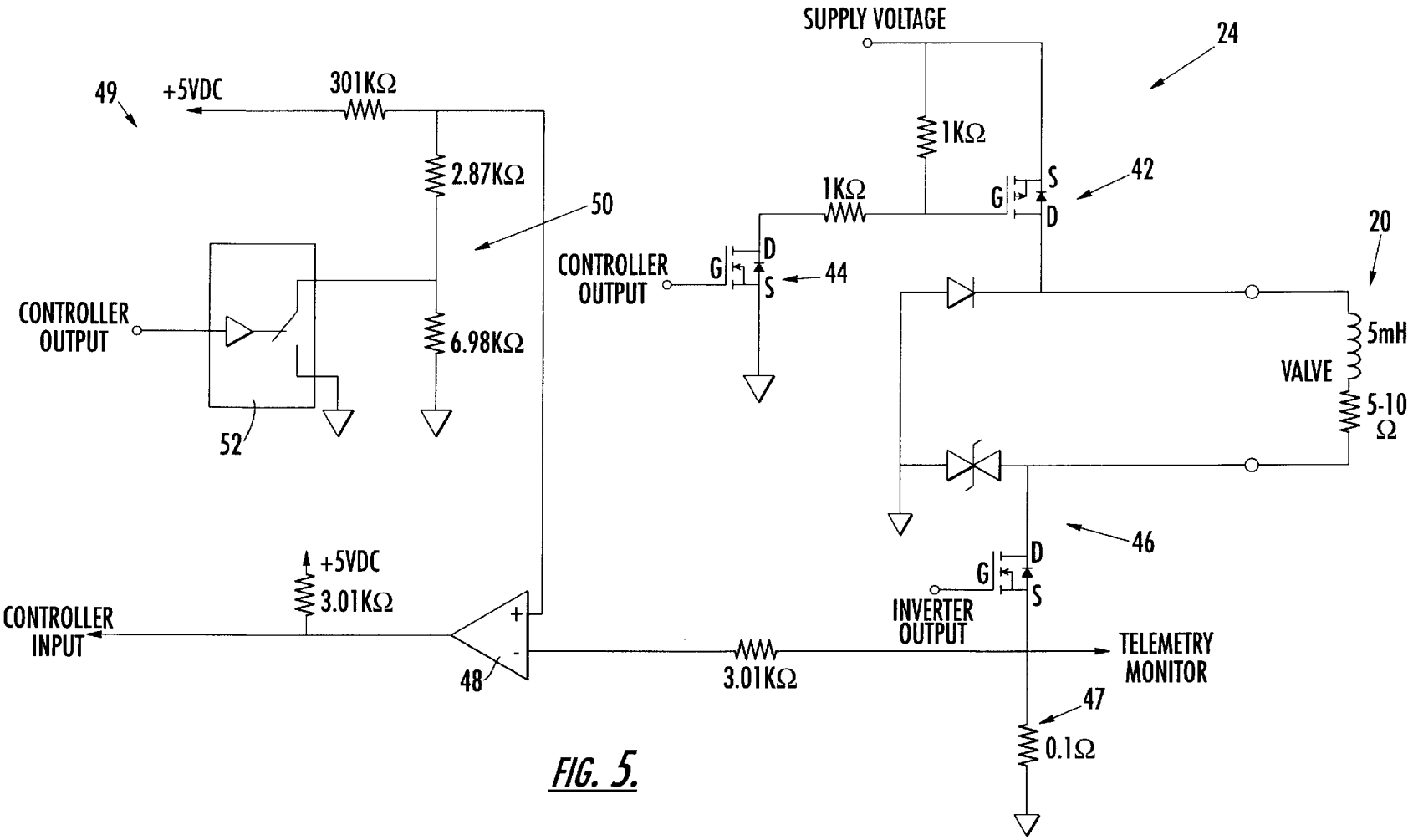
FIG. 5 is a circuit diagram of a valve driver circuit of the universal driver circuit of one advantageous embodiment to the present invention.

As shown in FIG. 5 in which a circuit diagram of a valve driver circuit 24 is depicted, each valve driver circuit also includes a number of the same components as the ordnance driver circuit 26. In this regard, the valve driver circuit includes a power switch 42, such as a p-channel MOSFET, for controllably providing current to the valve 20 by controllably connecting the valve to the supply voltage to open the valve. In addition, the valve driver circuit can include a control switch 44 disposed between the controller 28, such as the programmable logic device, and the power switch in order to appropriately bias the power switch in response to the control signals provided by the controller indicating that the valve should be opened or closed. As shown in FIG. 5, the control switch is typically an n-channel MOSFET that operates in the same fashion as described above in conjunction with the ordnance driver circuit.

The valve driver circuit 24 also preferably includes an on/off switch 46, such as an n-channel MOSFET, as depicted in FIGS. 2 and 5 and as described above in conjunction with the ordnance driver circuit. The on/off switch again serves to quickly close the valve 20 in response to a signal from the inverter 32 by opening so as to prevent further current flow through either the valve or the on/off switch. As shown in FIG. 5, a valve is typically modeled by an inductor in series with a resistor, such as a 5 millihenry inductor and a 5–10 ohm resistor. As such, the on/off switch may serve a more valuable purpose in conjunction with the valve driver circuit than the ordnance driver circuit since the inductive component of the valve would otherwise cause the valve to slowly close. Since the valve typically controls the flow of fuel from the combustion chamber, it is desired to quickly open and quickly close the valve such that the propulsion effectively starts and stops on demand and the resulting path of a missile can be accurately determined. As described above in conjunction with the ordnance driver circuit, a telemetry signal can also be monitored between the on/off switch and the relatively small resistor 47 that connects the on/off switch to ground in order to provide in-flight data for analysis, storage or the like.

Figure 6:
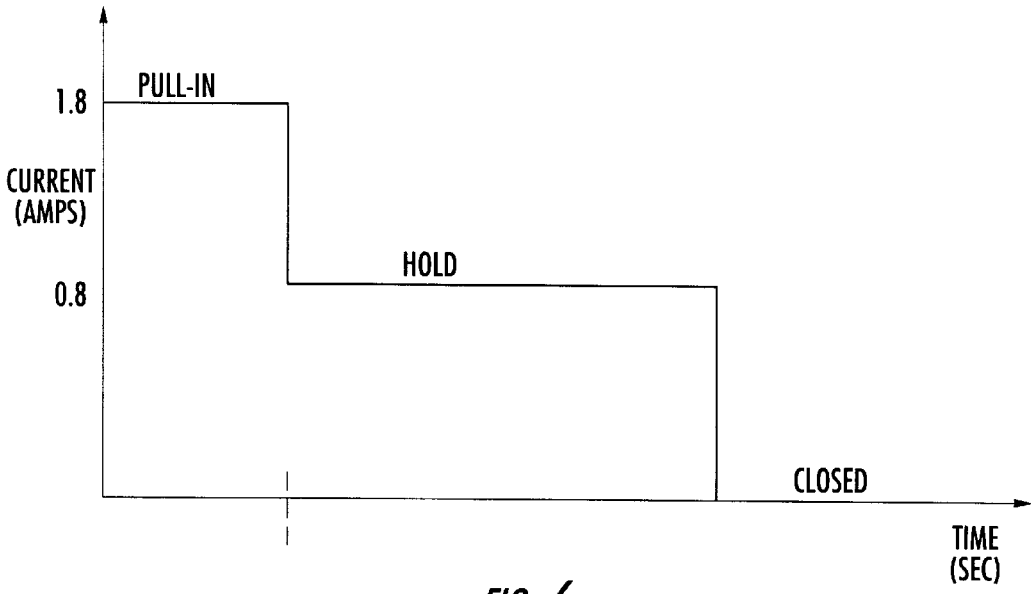
FIG. 6 is a simplified graph of the current provided to a valve in order to open the valve.

In contrast to the ordnance driver circuit 26, the valve driver circuit 24 also generally includes a level control and feedback circuit 49 as shown in FIGS. 2 and 5. The level control and feedback circuit serves to monitor the current flowing through the valve 20 in order to provide feedback to the controller 28, such as the programmable logic device of the illustrated embodiment. As such, the controller can appropriately control the current delivered to the valve. In this regard, a valve generally requires a greater amount of current during an initial stage in which the valve is being opened. The greater amount of current is typically referred to as the pull-in current and, in one embodiment, is about 1.8 amps for a predetermined pull-in time of 0.9 milliseconds to 1.2 milliseconds. Once the valve has been opened as a result of providing the valve with the pull-in current, a lesser amount of current can be provided to the valve in order to maintain the valve in open position. In this regard, a hold current, such as about 0.8 amps, can be provided once the valve has been opened for the remainder of the period of time during which the valve is to remain in an open position. In order to close the valve, current can then be removed from the valve. By way of example, FIG. 6 illustrates the pull-in current provided to a valve in order to originally open the valve and the hold current provided to the valve to hold the valve in an open position as well as the subsequent removal of current from the valve in order to close the valve.

The controller 28 generally includes a predefined pull-in time for each respective valve, while the length of time that the valve will be held open is generally either (1) a predetermined time that is loaded into the controller or (2) dependent upon an input which would define not only when the valve is to be opened, but also when the valve is to be closed by a change of state of the input signals.

Figure 7:
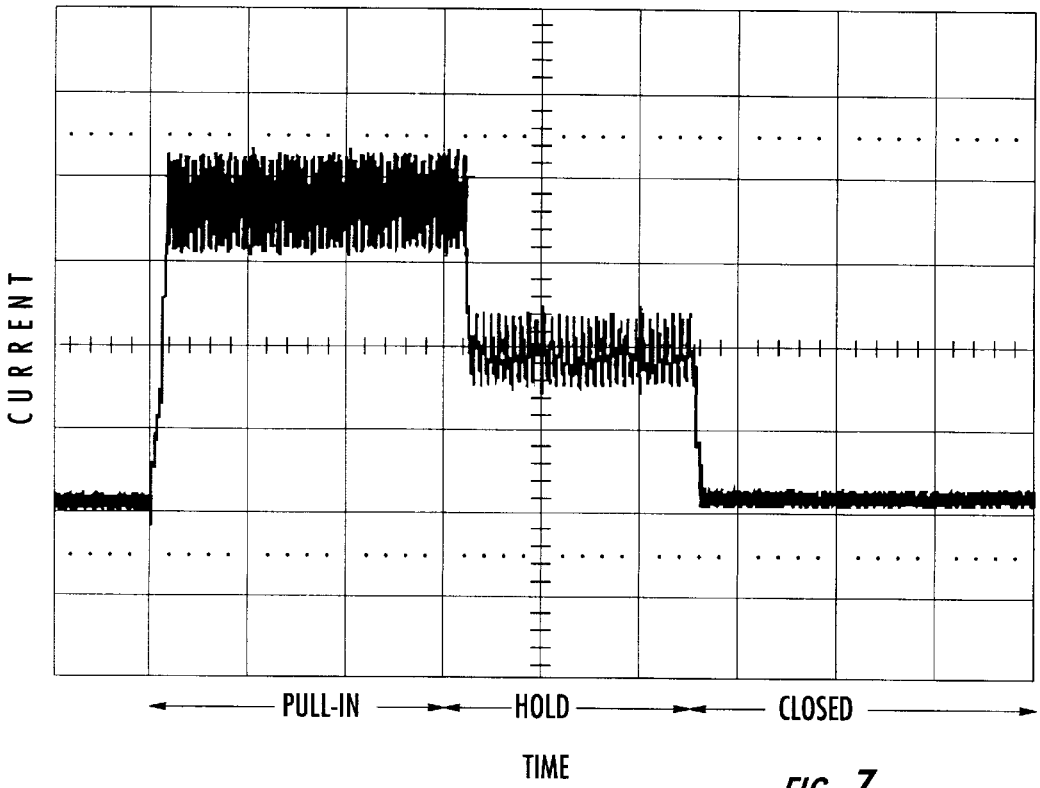
FIG. 7 is a graph of the actual current provided to a valve in order to open the valve.

The level control and feedback circuit of this embodiment also includes a comparator 48 for comparing a measure of the current provided to the valve 20 to a predetermined value in order to determine if the proper amount of current is being provided to the valve. In this regard, the comparator preferably compares the voltage appearing across the relatively small resistor 47 to a predetermined value and provides the controller with an indication of whether the voltage across the resistor is greater or less than the predetermined amount which, in turn, provides an indication that the current flowing through the valve is greater or less than desired. If less current is flowing through the valve than desired as indicated by the output of the comparator, the controller directs the control switch 44 to have the power switch 42 remain in a closed position such that the valve remains connected to the supply voltage and current flows through the valve. If, however, the current provided to the valve is greater than desired as indicated by the voltage appearing across the relatively small resistor being greater than the predetermined value, the comparator provides the controller with a feedback signal such that the controller, in turn, directs the control switch to have the power switch open, thereby disconnecting the valve from the supply voltage. Once the comparator detects that the voltage across the resistor falls below the predetermined level, the comparator provides the controller with another signal which causes the controller to direct the control switch to have the power switch be closed again in order to reconnect the valve to the supply voltage and to have current pass therethrough. As such, the current actually provided to the valve generally oscillates about the desired value as the power switch alternatively opens and closes as the voltage appearing across the resistor exceeds and then falls below the predetermined value, respectively. See, for example, FIG. 7, which illustrates the actual current provided to a valve during both the pull-in time and the hold time.

As shown in FIG. 5, the predetermined voltage level is generally set by a voltage divider network 50. Since the same comparator 48 is preferably utilized to analyze the current provided to the valve 20 in both the pull-in state and the hold state, the level control and feedback circuit 49 can include a switch 52 in parallel with one of the resistors of the voltage divider network. As such, the switch can be opened during the pull-in time such that the predetermined voltage established by the divider network is a relatively large voltage, such 0.18 V. However, during the hold state, the switch can be closed in order to short one of the resistors in the divider network and cause the predetermined voltage established by the divider network to be a lower value, such as 0.08 V, during the hold period. The current is therefore set to be $I=V/R=0.18\ V/0.1\ \Omega=1.8$ Amps for the pull-in current and $0.08V/0.1\ \Omega=0.8$ Amps for the hold current.

Since the universal driver circuit 22 of the present invention controllably actuates both valves 20 and ordnances 16, the universal driver circuit can therefore assist in the reduction in weight and reduction in space required by the control electronics of a missile or other unmanned air vehicle 10. In this regard, the universal driver circuit weighs less and occupies a smaller space than conventional control electronics since the entire multi-channel universal driver circuit is typically mounted upon a common circuit board and certain components, such as the controller 28, function to control each of the valve driver circuits 24 and the ordnance driver circuits 26 in order to decrease the number of redundant components required by the control electronics. As such, the missile or other unmanned air vehicle can either be lighter than conventional designs or more fuel can be carried by the missile or other unmanned air vehicle without increasing the overall weight in comparison to a missile or other unmanned air vehicle having conventional control electronics with separate valve driver circuits and ordnance driver circuits for each valve and ordnance, respectively.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for actuating both valves and ordnances comprising:

at least one valve drive circuit for opening and closing a valve, said valve driver circuit comprising:

a power switch for providing current to the valve in order to open the valve; and a comparator for comparing a measure of the current provided to the valve by said power switch to a predetermined value;

at least one ordnance driver circuit for activating an ordnance, said ordnance comprising a power switch for providing current to the ordnance to activate the ordnance; and a controller, communication with both said at least one valve driver circuit and said at least one ordnance driver circuit, for independently directing said power switches of said at least one valve driver circuit and said at least one ordnance driver circuit to open the valve and to activate the ordnance, respectively, said controller also responsive to said comparator of said at least one valve driver circuit so as to modify the current provided via said power switch of said at least one valve driver circuit to maintain the current provided to the valve near the predetermined current level.

2. An apparatus according to claim 1 wherein said controller directs said power switch of said at least one ordnance driver circuit to provide a first predetermined current to the ordnance, and wherein said controller directs said power switch of said at least one valve driver circuit to initially provide a second predetermined current to the valve in order to open the valve and to subsequently provide a third predetermined current to the valve in order to maintain the valve in an open position, wherein the first predetermined current is greater than the second predetermined current and the second predetermined current is greater than the third predetermined current.

3. An apparatus according to claim 2 wherein said comparator initially compares the measure of the current provided to the valve to a first predetermined value and subsequently compares the measure of the current provided to the valve to a second predetermined value.

4. An apparatus according to claim 1 wherein said at least one ordnance driver circuit further comprises a resistive element disposed in series with the ordnance to limit the current provided to the ordnance.

5. An apparatus according to claim 1 wherein said at least one ordnance driver circuit further comprises a control switch, responsive to said controller, for providing control signals to said power switch of said at least one ordnance driver circuit.

6. An apparatus according to claim 1 further comprising a circuit board upon which said at least one valve driver circuit, said at least one ordnance driver circuit and said controller are commonly mounted.

7. An apparatus for actuating both valves and ordnances comprising:

a circuit board;

at least one valve driver circuit, disposed upon said circuit board, for opening and closing a valve;

at least one ordnance driver circuit, disposed upon the same circuit board as said at least one valve driver circuit, for activating an ordnance; and a controller, disposed upon the same circuit board as both said at least one valve driver circuit and said at least one ordnance driver circuit, for independently directing said at least one valve driver circuit and said at least one ordnance driver circuit to open the valve and to activate the ordnance, respectively.

8. An apparatus according to claim 7 wherein said controller directs said at least one ordnance driver circuit to provide a first predetermined current to the ordnance, and wherein said controller directs said at least on valve driver circuit to initially provide a second predetermined current to the valve in order to open the valve and to subsequently provide a third predetermined current to the valve in order to maintain the valve in an open position, wherein the first predetermined current is greater than the second predetermined current and the second predetermined current is greater than the third predetermined current.

9. An apparatus according to claim 7 wherein said at least one ordnance driver circuit comprises a resistive element disposed in series with the ordnance to limit the current provided to the ordnance.

10. An apparatus according to claim 7 wherein said at least one ordnance driver circuit comprises a power switch for providing current to the ordnance to activate the ordnance.

11. An apparatus according to claim 10 wherein said at least one ordnance driver circuit further comprises a control switch, responsive to said controller, for providing control signals to said power switch of said at least one ordnance driver circuit.

12. An unmanned air vehicle comprising:

a vehicle body;

at least one ordnance disposed within said vehicle body;

at least one valve for delivering thrust to said vehicle body;

a universal driver circuit for actuating both said valves and said ordnances, said universal driver circuit comprising:

a valve driver circuit, associated with said valve, for opening and closing said valve;

an ordnance driver circuit, associated with a respective ordnance, for activating said ordnance; and a controller for independently directing both said valve driver circuit and said ordnance driver circuit to open said valve and to activate said ordnance, respectively.

13. An unmanned air vehicle according to claim 12 wherein said controller directs said at least one ordnance driver circuit to provide a first predetermined current to said ordnance, and wherein said controller directs said at least one valve driver circuit to initially provide a second predetermined current to said valve in order to open said valve and to subsequently provide a third predetermined current to said valve in order to maintain said valve in an open position, wherein the first predetermined current is greater than the second predetermined current and the second predetermined current is greater than the third predetermined current.

14. An unmanned air vehicle according to claim 12 wherein said at least one ordnance driver circuit comprises a resistive element disposed in series with said ordnance to limit the current provided to said ordnance.

15. An unmanned air vehicle according to claim 12 wherein said at least one ordnance driver circuit comprises a power switch for providing current to said ordnance to activate said ordnance.

16. An unmanned air vehicle according to claim 15 wherein said at least one ordnance driver circuit further comprises a control switch, responsive to said controller, for providing control signals to said power switch of said at least one ordnance driver circuit.

17. An unmanned air vehicle according to claim 12 further comprising a circuit board upon which said at least one valve driver circuit, said at least one ordnance driver circuit and said controller are commonly mounted.

18. An unmanned air vehicle according to claim 12 further comprising at least one battery associate with a respective ordnance such that activation of said ordnance by said ordnance driver circuit also activates said battery.

19. An unmanned air vehicle according to claim 12 further comprising a pressure tank, a fuel tank and an oxidizer tank, wherein the pressure tank is associated with a respective ordnance such that activation of said ordnance by said ordnance driver circuit causes flow from said pressure tank to said fuel tank and said oxidizer tank, thereby increasing pressure in said fuel tank and said oxidizer tank.

* * * * *

UNITED STATES PATENT AND TRADEMARK OFFICE

CERTIFICATE OF CORRECTION

PATENT NO. : 6,267,326 B1
DATED : July 31, 2001
INVENTOR(S) : Smith et al.

It is certified that error appears in the above-identified patent and that said Letters Patent is hereby corrected as shown below:

Column 10,
Line 57, "drive" should read -- driver --.

Column 11,
Line 1, after "controller," insert -- in --.

Column 12,
Line 56, "associate" should read -- associated --.

Signed and Sealed this

Nineteenth Day of March, 2002

*Attest:*

*Attesting Officer*

JAMES E. ROGAN
*Director of the United States Patent and Trademark Office*